US008266789B2

(12) United States Patent
Cardue et al.

(10) Patent No.: US 8,266,789 B2
(45) Date of Patent: Sep. 18, 2012

(54) DEVICE FOR THE PRODUCTION OF CABLE HARNESSES

(75) Inventors: Ray Peter Cardue, Fehrbellin (DE); Sebastian Gorecki, Opalenica (PL); Andreas Schulz, Schönermark (DE); Michael Seikel, Berlin (DE)

(73) Assignee: PAS Deutschland GmbH, Neuruppin (DE)

( * ) Notice: Subject to any disclaimer, the term of this patent is extended or adjusted under 35 U.S.C. 154(b) by 0 days.

(21) Appl. No.: 12/952,422

(22) Filed: Nov. 23, 2010

(65) Prior Publication Data

US 2011/0138611 A1 Jun. 16, 2011

Related U.S. Application Data

(63) Continuation of application No. PCT/EP2009/003635, filed on May 22, 2009.

(30) Foreign Application Priority Data

May 28, 2008 (DE) ..... 10 2008 026 986

(51) Int. Cl.
*H01B 13/012* (2006.01)

(52) U.S. Cl. ..... 29/755; 29/760; 269/11; 269/57

(58) Field of Classification Search ..... 29/755, 29/760; 269/11, 46, 55, 57, 58, 63
See application file for complete search history.

(56) References Cited

U.S. PATENT DOCUMENTS

| | | | | |
|---|---|---|---|---|
| 2,146,868 A | | 2/1939 | Wensley | 140/71 |
| 3,099,439 A | | 7/1963 | Haselton | 269/40 |
| 4,531,474 A | * | 7/1985 | Inuta | 118/503 |
| 4,742,612 A | | 5/1988 | Dokan et al. | 29/739 |
| 5,535,788 A | | 7/1996 | Mori et al. | 140/92.1 |
| 5,740,602 A | | 4/1998 | Peterson et al. | 29/748 |

FOREIGN PATENT DOCUMENTS

| | | | |
|---|---|---|---|
| DE | 3523308 A1 | | 1/1986 |
| DE | 3915854 A1 | | 11/1990 |
| FR | 2 496 388 | | 6/1982 |
| JP | 2000113750 A | | 4/2000 |
| JP | 2003026060 A | * | 1/2003 |

OTHER PUBLICATIONS

Machine translation of JP2003026060A, obtained Dec. 19, 2011.*
Translation of International Search Report and Written Opinion From Corresponding PCT Application No. PCT/EP2009/003635, Aug. 28, 2009 (6 pgs). As translated by WIPO IB.

* cited by examiner

*Primary Examiner* — Livius R Cazan
(74) *Attorney, Agent, or Firm* — Kevin E. Flynn; Flynn IP Law

(57) ABSTRACT

There is disclosed a device for a production of cable harnesses, said device having a stand, a rotor, at least two rotor arms and at least two mounting boards, said rotor rotatably mounted on said stand and said rotor having said at least two rotor arms on which said at least two mounting boards are mounted, wherein each mounting board of said at least two mounting boards is configured to allow producing at least one cable harness. In a preferred embodiment each mounting board of said at least two mounting boards is mounted on two rotor arms of said at least two rotor arms in a vertically adjustable manner, and said rotor has a rotor post which extends upward from said stand and to which said at least two rotor arms are mounted. In a further preferred embodiment at least one electrical stand contact is mounted to said stand and is configured to be connected to an electrical test device, and an electrical mating contact is associated with each mounting board and is adapted to be connected to a cable harness which is arranged on said mounting board, wherein said mating contact of each mounting board comes into electrical contact with said stand contact in a specific rotation position of said rotor, in order to connect said cable harness to said test device.

20 Claims, 4 Drawing Sheets

DEVICE FOR THE PRODUCTION OF CABLE HARNESSES

CROSS REFERENCES TO RELATED APPLICATIONS

This application is a continuation of international patent application WO 2009/143988 A1, filed on May 22, 2009 designating the U.S., which international patent application has been published in German language and claims priority from German patent application DE 10 2008 026 986.7, filed on May 28, 2008. The entire contents of these priority applications are incorporated herein by reference.

BACKGROUND OF THE INVENTION

The present invention relates to a device for the production of cable harnesses, in particular of cable harnesses for domestic appliances such as washing machines, tumble dryers, dishwashers etc.

The production of cable harnesses for such domestic appliances is time-consuming and costly. However, such cable harnesses should be produced in a cost-effective manner.

Cable harnesses can be manufactured on individual mounting or assembly boards. In the simplest case, the mounting boards are in the form of nail boards on which individual cables are laid and then connected to one another (by cable binders, tubes, by being wrapped with fabric tape etc.).

It is possible to use more complex mounting boards to electrically test a finished cable loom. For this purpose, such mounting boards have connectors in predetermined locations, it being possible for corresponding connecting pieces of the finished cable loom to be inserted into said connectors. These connectors can then be connected to a test device by a cable or the like.

When using individual mounting boards, the operating procedures are often highly complex, particularly when different variants are to be produced. The procedures can be optimized only with difficulty in the case of the production of cable harnesses.

Large electrically driven carousels can be used in order to produce highly complex cable harnesses (for example for the automobile industry). In the case of these large carousels, a plurality of mounting boards move continuously along a, for example oval, path. In each case, predetermined sections of the cable loom are manufactured at predetermined locations. The entire procedure corresponds more or less to a production line (line production).

Carousel-based solutions of this kind require a relatively large amount of space. In addition, the mechanical complexity of such large carousels is relatively high. Each board generally has some test devices. Furthermore, a busbar has to be present in order to ensure contact is continuous. The test devices are frequently connected to individual mounting boards by radio, this likewise resulting in relatively high costs.

Against the above background, the object of the invention is to specify an improved device for the production of cable harnesses, in particular of cable harnesses for domestic appliances, which device can be produced in a cost-effective manner and permits effective production.

SUMMARY OF THE INVENTION

There is provided an apparatus for the production of cable harnesses for domestic appliances, having a stand on which a rotor is rotatably mounted, said rotor having at least two rotor arms on which at least two mounting boards are mounted, it being possible to produce at least one cable harness on each mounting board.

Such a device for the production or manufacture of cable harnesses or cable looms can firstly be produced in a cost-effective manner. Since the mounting boards are mounted on an individual rotor, it is easy to advance them. Furthermore, it is possible to produce a cable loom sequentially since specific sections of the cable loom are produced at specific positions. A final mounting position (or rotation position of the mounting board) can be established, for example, as a test position.

Therefore, the procedures for manufacturing the cable looms can be configured highly efficiently overall.

In general, the production device according to the invention can be realized with two rotor arms and two mounting boards. However, the production device preferably has three or more mounting boards which are arranged adjacent to one another in the circumferential direction around the rotation axis of the rotor. It is particularly advantageous when the number of mounting boards is in the range of from five to seven mounting boards.

In general, it is possible to mount a mounting board on each rotor arm.

However, it is particularly preferred when each mounting board is mounted in each case on two rotor arms.

This firstly increases the stability of the mounting arrangement. In this case, the number of rotor arms and of mounting boards can be twice the number of mounting boards.

However, the number of rotor arms is ideally the same as the number of mounting boards. In this case, in each case the opposing sides of two adjacent mounting boards can be mounted, for example, on one rotor arm.

In a further refinement of the present invention the mounting boards are mounted on the rotor arms in each case in a vertically adjustable manner.

This can considerably increase the ergonomics of cable harness manufacture. In this case, vertical adjustability can be performed by motors. However, in the simplest and preferred case, this can be performed by a simple tilting or articulated mechanism.

In a further refinement of the present invention the rotor has a rotor post which extends upward from the stand and to which the rotor arms are mounted.

By virtue of the design of a rotor post of this kind, the rotor arms can in each case be in the form of a vertically oriented framework. In the simplest case, the mounting boards can, for example, also be mounted by a lower and an upper arm section.

Furthermore, it is possible to further rotate the rotor by hand. This can be done, for example as required, that is to say when the actions on all mounting boards are concluded.

In a further refinement of the present invention the production device has a motor which is designed to turn the rotor in relation to the stand.

The motor can be in the form of, for example, an electric motor, in particular a three-phase motor, a stepper motor or a servo motor. The power can, for example, be in the range of from 0.2 to 5 kW, preferably in the range of from 1 to 3 kW.

In a further refinement of the present invention the production device has a control device which is designed to turn the rotor in steps through a rotation angle in accordance with the number of mounting boards.

As a result, the rotor can be rotated further without any manual effort. It is also advantageous for the mounting boards to be able to remain stationary between the turning processes of the rotor, so that the manufacture of cable harnesses on the mounting boards is generally easier.

In this case, it is particularly advantageous when the control device has a timing device in order to turn the rotor through the rotation angle after a presettable time period has elapsed.

The presettable time period (holding time) can be, for example, in the range of from 5 to 200 seconds, preferably in the range of from 10 to 80 seconds. The turning time of the rotor can be, for example, in the range of from 1 to 10 seconds, preferably in the range of from 1.5 to 5 seconds.

In a further refinement of the present invention the control device has at least one limit switch or sensor (for example light barrier) which can be operated by the rotor arms in order to the stop the rotor after the rotation angle is reached.

In this way, the motor can be driven comparatively simply, for example by a time relay which is associated with the control device. The time relay can be reset, for example, by operating the limit switch or sensor, and therefore automatic stepwise operation can be established.

In a further refinement of the present invention at least one electrical stand contact is mounted to the stand, it being possible for said stand contact to be connected to an electrical test device, wherein an electrical mating contact is associated with each mounting board, it being possible to connect said mating contact to a cable harness which is arranged on the mounting board, wherein the mating contact of each mounting board comes into electrical contact with the stand contact in a specific rotation position of the rotor, in order to connect the cable harness to the test device.

This refinement permits an electrical connection between the mounting board and the test device to be established as soon as the rotor (or the relevant mounting board) reaches a specific rotation position (which is then established as the so-called test position).

A stand contact or mating contact of this kind can be formed in a very wide variety of ways, but can be realized in a relatively simple manner in terms of design on account of the purely rotary relative movement between the rotor and the stand.

The operating procedures for manufacturing and testing a cable harness can be further simplified as a result.

In a further refinement of the present invention the stand has a stand post, wherein the rotor has a rotor post which is in the form of a hollow post and surrounds the stand post.

In this refinement, the rotor can firstly be rotationally mounted in a manner which is expedient in terms of design. Secondly, the concentric arrangement of the stand post and the rotor post permits the stand contact and mating contact to be realized in a manner which is simple in terms of design.

Therefore, it is particularly advantageous when the electrical stand contact is mounted to the stand post.

In a further refinement of the present invention the mating contact is in the form of an electrical sliding contact.

In this case, the sliding contacts can be provided on a cylinder element which is mounted to the rotor. As a result, the production device can be produced in a simple manner. It goes without saying that each mounting board is provided with its own sliding contact.

It also goes without saying that a large number of stand contacts and a correspondingly large number of mating contacts are provided for each mounting board, for example in the range of from 10 to 200 contacts, in particular in the range of from 20 to 80 contacts.

In this way, a corresponding number of test signals can be routed from the mounting board to the test device.

In a further refinement of the present invention at least one lighting device is mounted in the region of an upper end of the stand post.

By virtue of this measure, it is possible to illuminate the mounting boards in a deliberate and efficient manner. Although such lighting devices could, in general, also be provided on the respective mounting boards, in this case a corresponding electrical sliding contact pairing would be provided between the rotor and stand for making electrical contact with and supplying power to the lighting device which is carried along in rotation.

In a further refinement of the present invention each rotor arm has a lower arm section, which is radially relatively long, and an upper arm section, which is radially relatively short. In this way, it is possible to arrange the mounting boards with a certain degree of inclination with respect to the vertical in each case. The angle of inclination can be, for example, in the range of from 5°-45°.

In a further refinement of the present invention coupling members, which are in each case mounted in an articulated manner, are connected in an articulated manner to the upper and the lower arm sections, the free ends of said coupling members being connected to the respective mounting board. As a result, said mounting boards can be vertically adjusted in a manner which is simple in terms of design.

It goes without saying that the features mentioned above and those still to be explained below can be used not only in the respectively indicated combination but also in other combinations or on their own, without departing from the scope of the present invention.

BRIEF DESCRIPTION OF THE DRAWINGS

Preferred embodiments of the invention are illustrated in the drawing and will be explained in greater detail in the following description. In said drawing.

DESCRIPTION OF PREFERRED EMBODIMENTS

Figure 1:
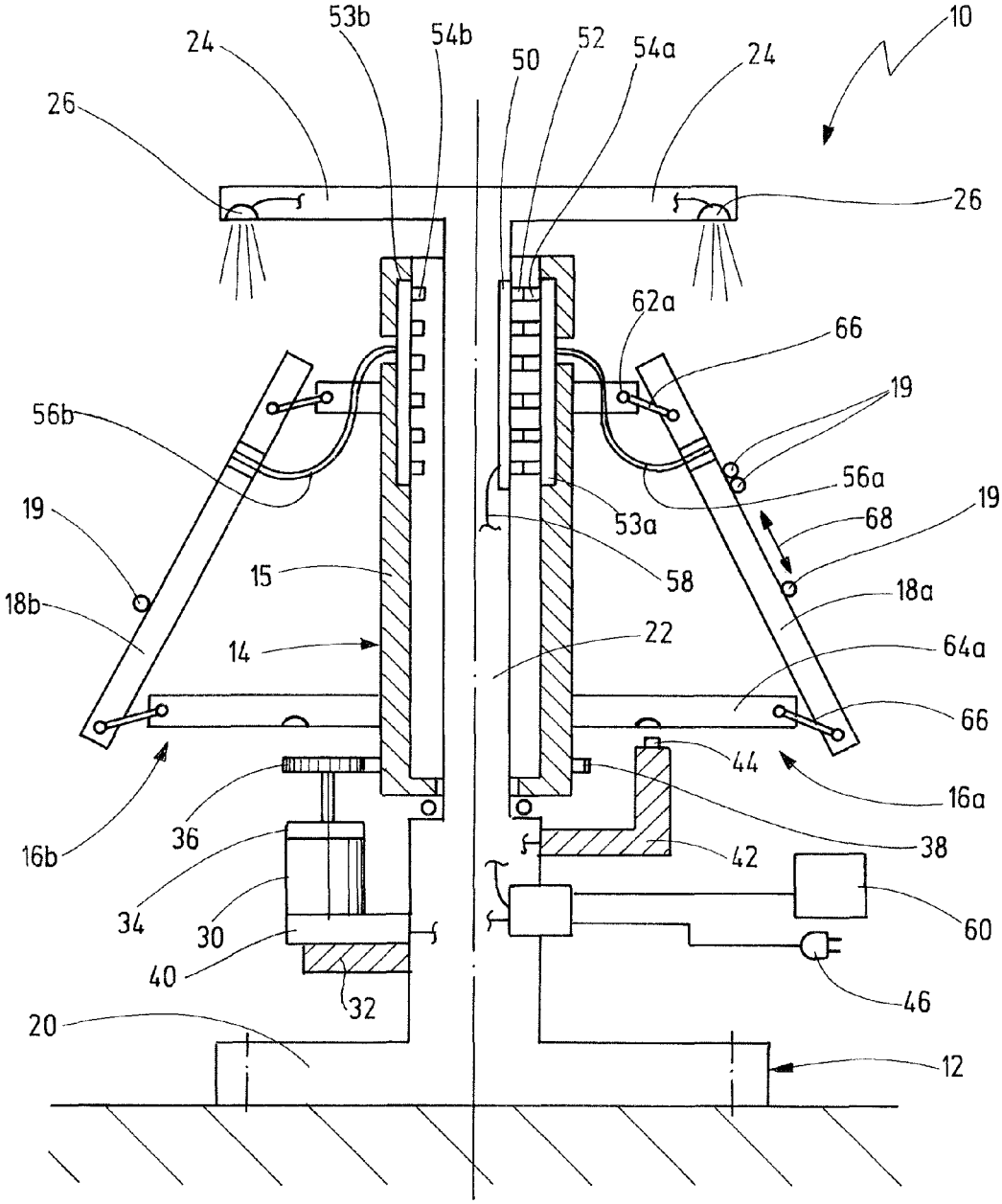
FIG. 1 shows a schematic cross-sectional view of a device for the production of cable harnesses according to the invention.

In FIG. 1, a first embodiment of a device for the production of cable harnesses according to the invention is denoted 10 in general.

The production device 10 has a stand 12 which is erected on a floor or foundation (or is anchored to the foundation, as is shown by schematic dash-dotted lines in FIG. 1).

The production device 10 also has a rotor 14 which contains a hollow rotor post 15 which generally extends vertically.

The rotor 14 is mounted on the stand by bearings (for example roller bearings, which are not specifically illustrated). The rotation axis schematically illustrated in FIG. 1 generally runs in the vertical direction.

A plurality of rotor arms 16*a*, 16*b* are mounted to the outer circumference of the rotor post 15. Mounting boards 18*a*, 18*b* are mounted on the rotor arms 16*a*, 16*b*. The mounting boards 18*a*, 18*b* are in each case somewhat inclined in relation to the vertical and, on their radially outward facing side, have a mounting surface on which cable harnesses 19 can be manufactured in a manner which is known per se.

The number of rotor arms 16 and/or the number of mounting boards 18 can be, for example, in the range of from two to eight. The number is preferably three or more, in particular, for example, a maximum of six.

The stand 12 has a stand base 20 which can contain, for example, a plurality of feet, which extend in the radial direction, in order to ensure that the production device 10 stands in a secure manner. The stand 12 further has a stand post 22 which extends vertically upward from the stand base 20. The rotor post 15 is arranged concentrically with and surrounds said stand post 22.

In the illustrated embodiment, the stand post 22 extends upward in the vertical direction out of the rotor post 15 and, at its upper end, has one or more lighting arms 24. Lighting devices 26 are mounted to the free ends of the lighting arms 24 and are designed to illuminate the mounting surface of the mounting boards 18*a*, 18*b* which faces radially outward, as is schematically indicated in FIG. 1.

The stand 12 is purely schematically illustrated in FIG. 1. It goes without saying that connection cables for the lighting devices 26 can be routed through the stand post 22. The stand post 22 can also be in the form of a hollow post.

In general, the stand 12 and the rotor 14 are produced from simple metal profiles, for example from aluminum.

An electric motor 30 (for example a three-phase motor) is mounted to the stand base 20. A motor arm 32 can be mounted to the stand base 20 for this purpose. The motor 30 serves to drive the rotor 14 in rotation. For this purpose, the motor 30 can be connected to a drive gear 36 via a gear mechanism 34, the axis of said drive gear being oriented generally vertically. A rotor gear 38 which engages with the drive gear 36 is mounted to the rotor 14 (preferably to the outer circumference of the rotor post 15). The rotor 14 can be moved at a suitable angular speed, which can be, for example, in the range of from 5° to 30°/second, by suitable selection of a gear mechanism 34 and of the transmission ratio which is established by the drive gear 36 and the rotor gear 38.

A control device 40 is also associated with the motor 30. The control device 40 controls the electric motor 30 at suitable times in order to set the rotor 14 in rotation. It is particularly preferred when the control device 40 is designed to establish a step mode. In this case, the rotor 14 is in each case moved through an angle of 360°/n and then stopped again. In this case, the variable n corresponds to the number of mounting boards 18. The stop time can be, for example, in the range of from 5 to 200 seconds. In each case one partial manufacturing process for the production of a cable loom can be performed on all the mounting boards during the stop time (or a test can be performed on one mounting board if desired).

The control device 40 preferably has a timing device, such as a time relay or an electronic counter, for establishing this step mode. During the active phase of the timing device, the electric motor 30 is supplied with power, and therefore the rotor 14 is moved. As soon as a predetermined rotation position is reached (360°/n), the motor 30 is stopped again. In order to simplify this, a sensor arm 42 can be provided on the stand base 22, a position sensor 44 being mounted to said sensor arm. The position sensor 44 can be in the form, for example, of a limit switch which detects when a rotor arm (and/or a mounting board) has reached a specific rotation position. The motor 30 can be stopped by the sensor signal from the position sensor 44 which is generated as a result. The timing device is preferably also reset in this case.

FIG. 1 also shows that the stand base 20 can be connected to a mains plug 46 by a cable (not specifically denoted). The mains plug 46 can be connected to the lighting devices 26 by a suitable cabling arrangement, for example within the stand 12. Furthermore, electrical power can be supplied to the electric motor 30 and to the control device 40 by the mains plug 46. The mains connection used for this purpose can contain, for example, a three-phase connection.

A stand control strip 50, which is oriented in the vertical direction and has a plurality of stand contacts 52, is mounted to the stand post 22. Furthermore, a mating contact section 53 is formed on the rotor post 15 in association with each mounting board 18*a*, 18*b*. The mating contact section 53 has a plurality of mating contacts 54*a* and 54*b* which are oriented in a vertical manner and, for example, can be in the form of electrical sliding contacts.

FIG. 1 shows that the mating contacts 54*a* of the mating contact section 53*a* are electrically connected to the stand contacts 52 of the stand contact strip 50. In contrast, the mating contacts 54*b* of the mating contact section 53*b*, which is associated with the mounting board 18*b*, is not in contact with the stand contact strip 50.

The mating contact sections 53*a*, 53*b* are connected to the associated mounting plates 18*a*, 18*b* by respective connecting cables 56*a*, 56*b* (for example ribbon cables). In this case, the connecting cables 56*a*, 56*b* are connected, for example, to prepared connectors (not illustrated) on the mounting surface of the mounting boards 18*a*, 18*b*.

The stand contact strip 50 can also be connected to a test device 60 (which can contain, for example, a PC or the like) by a test cable 58 (which can likewise be routed, for example, within the stand 12).

The test device 60 can consequently conduct test signals to the mounting board 18, of which the cable set 19 is to be tested, by the test cable 58, the stand control strip 50, the mating contact section 53 and the connecting cable 56. Furthermore, corresponding signals can be returned to the test device 60 by the same lines.

The rotor arms 16*a*, 16*b* each have an upper arm section 62, which is short in the radial direction, and a lower arm section 64, which is long in the radial direction. On account of the different lengths of the arm sections 62, 64, the mounting plates 18 can each be arranged with a certain degree of inclination with respect to the vertical direction.

In this case, FIG. 1 shows that the mounting plates 18 are connected to the arm sections 62, 64 by respective coupling members 66 which are mounted in an articulated manner. In this way, the mounting plates 18 can be moved at least between a lower and an upper position, in order to thus improve the ergonomics of the production device 10. The corresponding adjustment direction of the mounting plates 18 is shown in FIG. 1 at 68.

Figure 2:
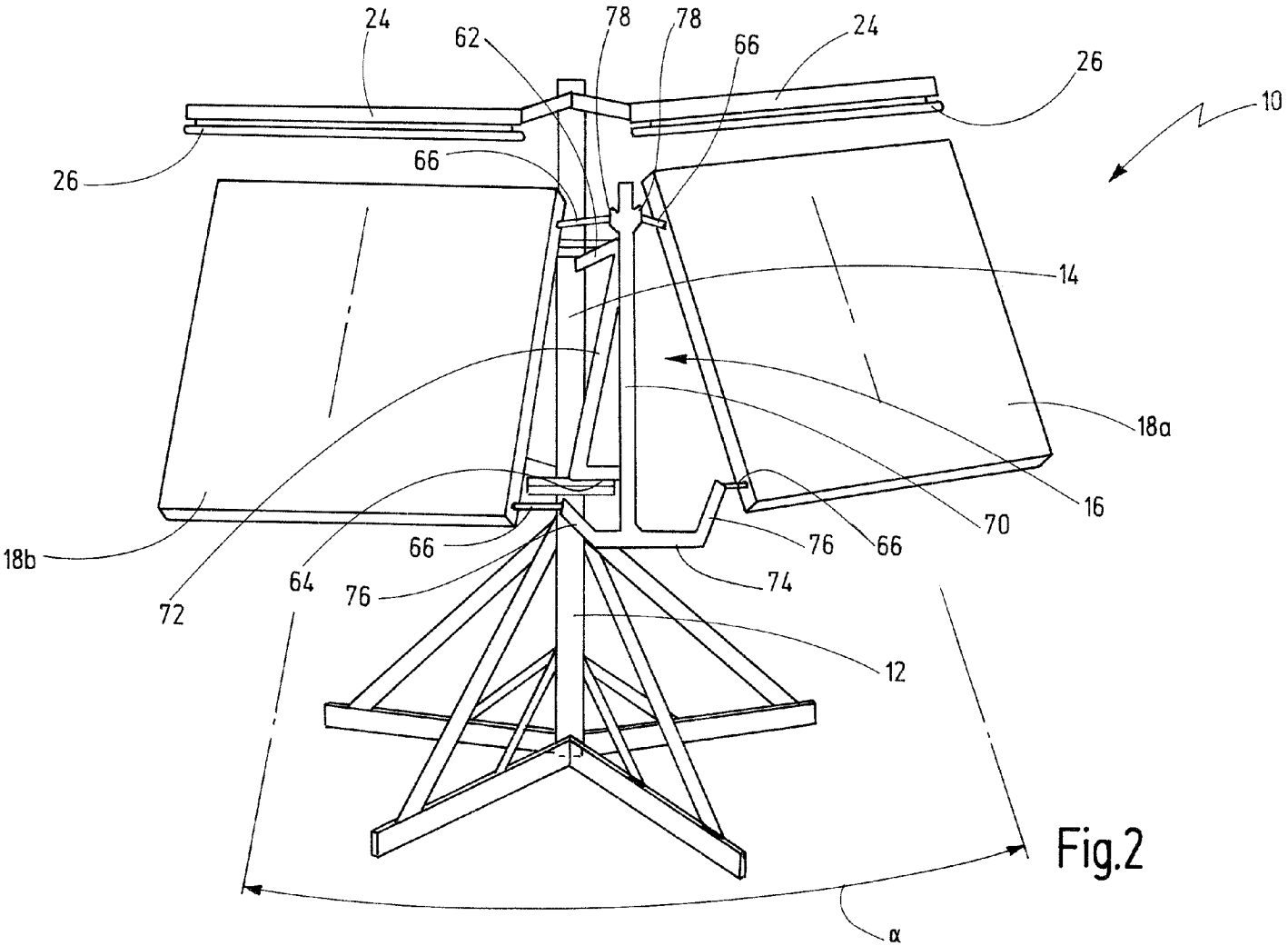
FIG. 2 shows a schematic perspective view of a further embodiment of a device for the production of cable harnesses according to the invention.
Figure 3:
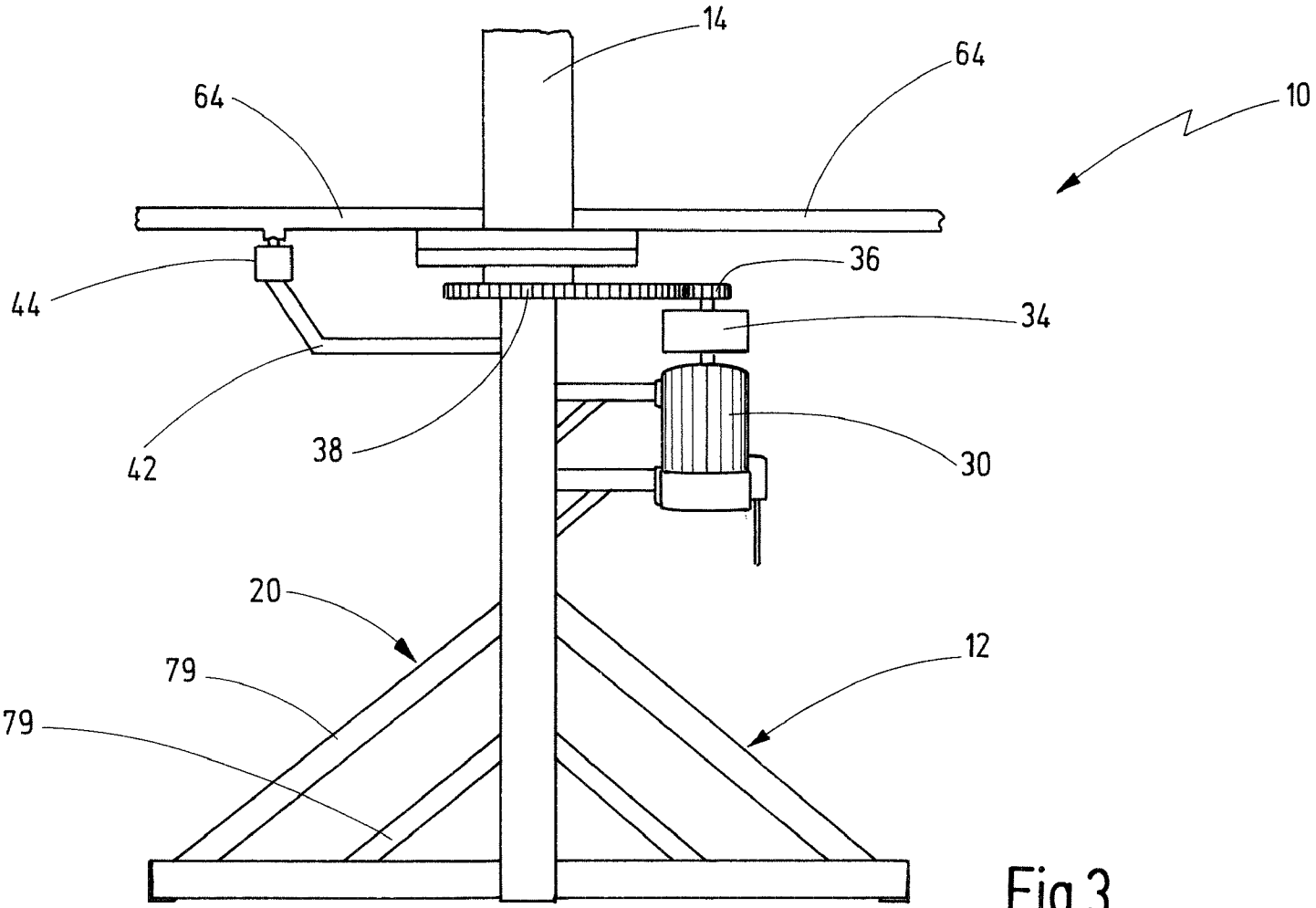
FIG. 3 shows a schematic cross-sectional view of a lower region of a further embodiment of a device for the production of cable harnesses according to the invention.
Figure 4:
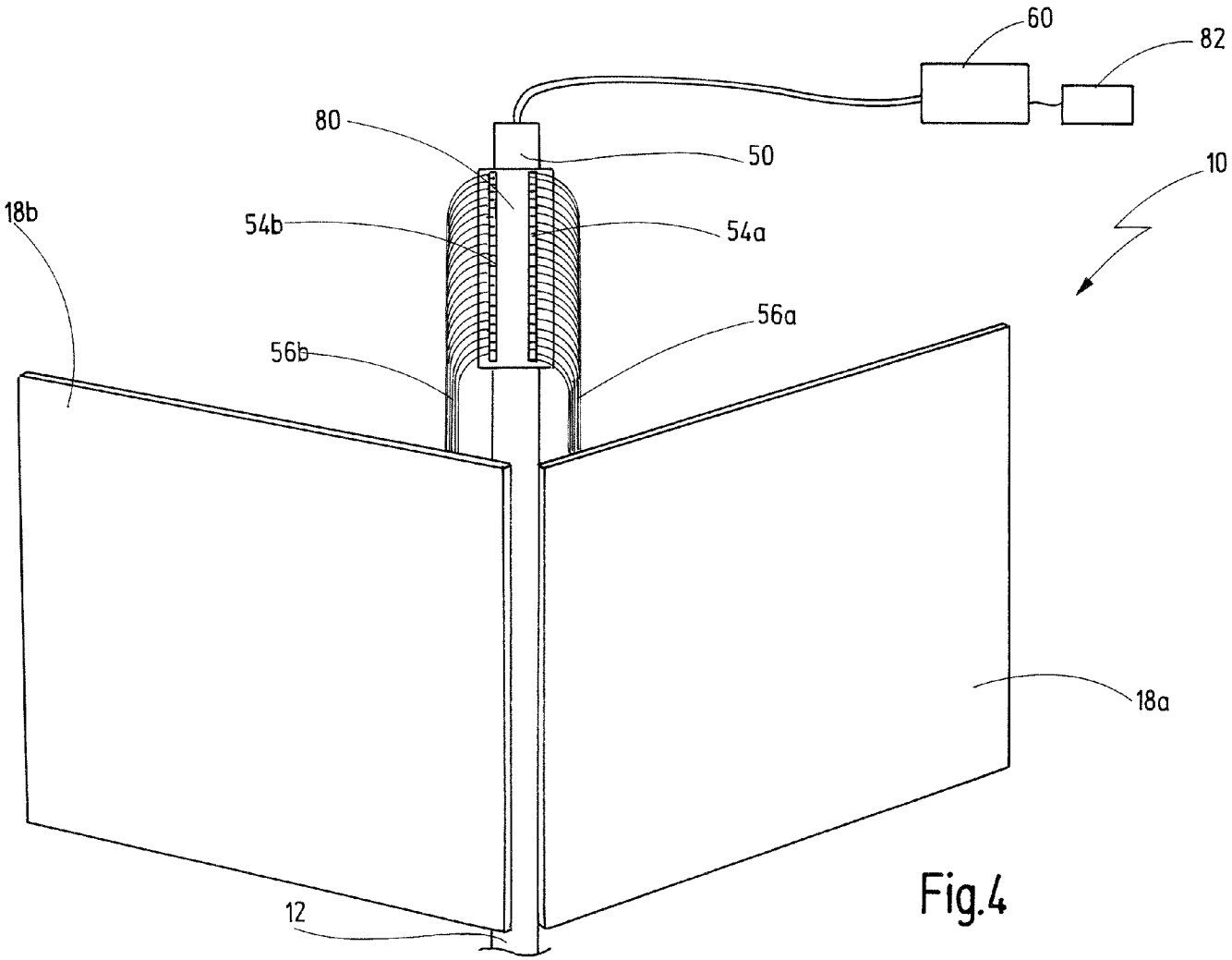
FIG. 4 shows a schematic illustration of an upper section of a further embodiment of a device for the production of cable harnesses according to the invention.

FIGS. 2 to 4 show further alternative embodiments of production device 10 according to the invention. These production devices generally correspond, in terms of design and manner of operation, to the production device 10 described in relation to FIG. 1. Identical elements are therefore denoted using the same reference numerals. Only the differences are explained in the text which follows.

Firstly, FIG. 2 shows the rotation angle $\alpha$ which results from the above formula 360°/n (where n is the number of mounting boards 18).

Furthermore, FIG. 2 shows a preferred design of rotor arms 16. In this embodiment, the rotor arms 16 are generally arranged in the circumferential direction between two mounting boards 18*a*, 18*b* and support opposite sides of these mounting boards 18*a*, 18*b*.

The rotor arms 16 are in the form of framework structures and contain a longitudinal strut 70 which connects the ends of the upper arm section 62 and of the lower arm section 64. A reinforcement strut 72 also extends between a foot point of the lower arm section 64 and the free end of the upper arm section 62.

A transverse strut 74 is provided at a lower end of the longitudinal strut 70, respective lower connecting struts 76 being mounted to the free ends of said transverse strut. The coupling members 66 are connected to the lower connecting struts 76 in an articulated manner. Furthermore, corresponding coupling members 66 are connected to upper connecting struts 78 in an articulated manner, said connecting struts being mounted to an upper section of the longitudinal strut 70.

FIG. 3 shows a further alternative embodiment of a production arrangement 10 according to the invention, only a lower section of said production arrangement being illustrated. Said figure shows that the stand base 20 can have a plurality of obliquely running support struts 79 which connect the stand post 22 to radial feet of the stand base 20 in order to improve the tilting stability of the production device 10. Said figure also shows that the rotor 14 has a lower flange section (not specifically denoted) which can be, for example, in the form of a circular plate. In a corresponding manner, the stand 12 can have such a circular plate, suitable bearings, such as roller bearings, being arranged between said circular plates in order to rotatably mount the rotor 14 in a smooth-running yet stable manner.

FIG. 4 shows a further embodiment of a production device 10 according to the invention.

Said figure shows that a cylinder element 80 is provided on the rotor, it being possible for said cylinder element to have a large number of mating contacts 54*a*, 54*b* in the form of sliding contacts. These sliding contacts are combined by respective lines to form the connecting conductors 56*a*, 56*b*.

FIG. 4 also shows that the test device 60 can be connected to a printer 82.

Even though the present variants in which the stand contacts 52 are arranged radially on the inside and mating contacts 54 are arranged radially on the outside, this embodiment can also be reversed by, for example, a stand contact strip 50 being mounted radially on the outside in relation to the rotor 14.

Furthermore, the lighting devices 26 can also be mounted directly to the mounting boards 18. In this case, sliding contact pairs for supplying electrical power to the lighting device can accordingly be provided between the rotor and the stand.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the words "comprising" and "having" do not exclude other elements, and the indefinite article "a" or "an" does not exclude a plurality. A single element or other unit may fulfill the functions of several items recited in the claims. The mere fact that certain measures are recited in mutually different dependent claims does not indicate that a combination of these measured cannot be used to advantage.

What is claimed is:

1. A device for a production of cable harnesses, said device having a stand, a rotor, at least two rotor arms and at least two mounting boards, said rotor rotatably mounted on said stand and said rotor having said at least two rotor arms on which said at least two mounting boards are mounted, wherein each mounting board of said at least two mounting boards is mounted on two rotor arms of said at least two rotor arms in a vertically adjustable manner and is configured to allow producing at least one cable harness, and wherein said rotor has a rotor post which extends upward from said stand and to which said at least two rotor arms are mounted;

wherein at least one electrical stand contact is mounted to said stand and is configured to be connected to an electrical test device, and wherein an electrical mating contact is associated with each mounting board and is adapted to be connected to a cable harness which is arranged on said mounting board, wherein said mating contact of each mounting board comes into electrical contact with said electrical stand contact in a specific rotation position of said rotor, in order to connect said cable harness to said electrical test device.

2. The device as claimed in claim 1, having a motor which is configured to turn said rotor in relation to said stand.

3. The device as claimed in claim 1, having a control device which is configured to turn said rotor in steps by a rotation angle in accordance with a number of said at least two mounting boards.

4. The device as claimed in claim 1, wherein said stand has a stand post, and wherein said rotor has a rotor post which is in the form of a hollow post and surrounds said stand post.

5. The device as claimed in claim 1, wherein said mating contact is in the form of an electrical sliding contact.

6. The device as claimed in claim 1, wherein said rotor arms have a lower arm section, which is longer in a radial direction, and an upper arm section, which is radially shorter, so that the mounting board which is mounted on said rotor arms is inclined in relation to a vertical.

7. A device for a production of cable harnesses, said device having a stand, a rotor, at least two rotor arms and at least two mounting boards, said rotor rotatably mounted on said stand and said rotor having said at least two rotor arms on which said at least two mounting boards are mounted, wherein each mounting board of said at least two mounting boards is configured to allow producing at least one cable harness;

wherein at least one electrical stand contact is mounted to said stand and is configured to be connected to an electrical test device, and wherein an electrical mating contact is associated with each mounting board and is adapted to be connected to a cable harness which is arranged on said mounting board, wherein said mating contact of each mounting board comes into electrical contact with said electrical stand contact in a specific rotation position of said rotor, in order to connect said cable harness to said electrical test device.

8. The device as claimed in claim 7, wherein each of the at least two mounting boards is mounted on two rotor arms of said at least two rotor arms.

9. The device as claimed in claim 7, wherein each of the at least two mounting boards is mounted on said at least two rotor arms in a vertically adjustable manner.

10. The device as claimed in claim 7, wherein said rotor has a rotor post which extends upward from said stand and to which said at least two rotor arms are mounted.

11. The device as claimed in claim 7, having a motor which is configured to turn said rotor in relation to said stand.

12. The device as claimed in claim 7, having a control device which is configured to turn said rotor in steps by a rotation angle in accordance with a number of said at least two mounting boards.

13. The device as claimed in claim 12, wherein said control device has a timing device in order to turn said rotor by said rotation angle after a presettable time period has elapsed.

14. The device as claimed in claim 12, wherein said control device has at least one limit switch which is operable by said at least two rotor arms in order to stop said rotor after said rotation angle is reached.

15. The device as claimed in claim 7, wherein said stand has a stand post, and wherein said rotor has a rotor post which is in the form of a hollow post and surrounds said stand post.

16. The device as claimed in claim 15, wherein said electrical stand contact is mounted to said stand post.

17. The device as claimed in claim 7 wherein said mating contact is in the form of an electrical sliding contact.

18. The device as claimed in claim 15, wherein at least one lighting device is mounted to said stand post in a region of an upper end.

19. The device as claimed in claim 7, wherein said rotor arms have a lower arm section, which is longer in a radial direction, and an upper arm section, which is radially shorter, so that the mounting board which is mounted on said rotor arms is inclined in relation to a vertical.

20. The device as claimed in claim 19, wherein said mounting board is connected to said lower and to said upper arm sections by coupling members which are mounted in an articulated manner, wherein said mounting board can be vertically adjusted at least between two positions by said coupling members.

* * * * *